US007552509B2

(12) United States Patent
Chen et al.

(10) Patent No.: US 7,552,509 B2
(45) Date of Patent: Jun. 30, 2009

(54) HINGE BUFFER DEVICE

(75) Inventors: Ken-Ching Chen, Kaohsiung Hsien (TW); Ting-Tsai Huang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 216 days.

(21) Appl. No.: 11/599,310

(22) Filed: Nov. 15, 2006

(65) Prior Publication Data

US 2008/0109987 A1 May 15, 2008

(51) Int. Cl.
*E05F 3/20* (2006.01)

(52) U.S. Cl. ..... 16/50; 16/286

(58) Field of Classification Search ..... 16/50, 16/54, 286, 371
See application file for complete search history.

(56) References Cited

U.S. PATENT DOCUMENTS 1,700,086 A * 1/1929 Alonson ..... 16/85
1,701,022 A * 2/1929 Thornton ..... 16/54
1,706,656 A * 3/1929 Collins ..... 16/68
2,078,815 A * 4/1937 Lee ..... 16/286
2,516,935 A * 8/1950 Weaver ..... 16/50
2,848,734 A * 8/1958 Jay ..... 16/87.4 R
2,982,988 A * 5/1961 Blackmer ..... 16/97
3,251,089 A * 5/1966 Fergison ..... 16/246
4,115,897 A * 9/1978 Zunkel ..... 16/49
4,555,828 A * 12/1985 Matimura ..... 16/95 R
6,591,454 B2 7/2003 Brustle
6,684,453 B2 2/2004 Wang
7,275,284 B2 * 10/2007 Lautenschlager et al. ..... 16/287
2003/0229965 A1 * 12/2003 Wang ..... 16/54
2004/0211032 A1 * 10/2004 Rojic ..... 16/87 R
2005/0015927 A1 * 1/2005 Kropf ..... 16/286
2005/0097705 A1 * 5/2005 Chen ..... 16/326

* cited by examiner

*Primary Examiner*—Victor Batson
*Assistant Examiner*—Roberta Delisle
(74) *Attorney, Agent, or Firm*—Rosenberg, Klein & Lee

(57) ABSTRACT

A hinge buffer device includes a casing, a slide, a buffer and an adjustment. The casing comprises a first end, a second end, a pair of lugs, a threaded hole, and a sliding trough. The lugs are disposed at two sides of the first end of the casing. The threaded hole is formed at the second end of the casing. The sliding trough is located between the first end and the second end of the casing. The slide comprises a compartment, a pair of sliding sections at respective sides to be engaged with the sliding trough of the casing. The buffer is a cylinder to be mounted in the compartment of the slide. The buffer comprises a piston rod secured to the slide. The adjustment is connected to the slide, and comprises a bolt to be engaged with the threaded hole of the casing.

7 Claims, 8 Drawing Sheets

HINGE BUFFER DEVICE

BACKGROUND OF THE INVENTION

1. Field of the Invention

The present invention relates to a hinge buffer device, in particular to a device having an adjustment to adjust the position and the buffer force of a buffer.

2. Description of the Prior Art

A conventional furniture hinge comprises a hinge base, a hinge arm and a fixed plate. The hinge arm is pivotally connected to the hinge base in an expandable status. The hinge base is usually secured to a panel while the hinge arm is secured to the fixed plate on a cabinet. The hinge arm is provided with an elastic member to restore the panel back to its original position so as to cover the cabinet. However, the panel mounted with the hinge of the prior art will hit the cabinet directly without any buffer force. Therefore, some of the cabinets are installed with a buffer device to avoid a direct hit of the panel to the cabinet.

Most of the buffer devices comprise a casing and a buffer member. The buffer member is disposed in the casing, and the casing is mounted on the panel or the cabinet. The buffer member is generally made of pneumatic rod or hydraulic rod. Some of the buffer members may be an elastic element which is easily malfunctioned.

The buffer device will engage the panel of the cabinet when it is closed, and the elastic element of the extension arm has a weak resistance to slow the closing movement of the panel.

However, after a period of time, the hardware will fatigue and require making an adjustment. The adjustment may also require a realignment. As disclosed in U.S. Pat. No. 6,591,454 B2, the buffer member can not be realigned. Some of the buffer members require to adjust at least two bolts to do the alignment, which is inconvenient.

SUMMARY OF THE INVENTION

It is the primary objective of the present invention to provide a hinge buffer device, which has an adjustment to adjust the position of a buffer and to change the buffer's reaction.

The present invention comprises a casing, a slide, a buffer and an adjustment. The casing comprises a first end, a second end, a pair of lugs disposed at two sides of the first end of the casing, a threaded hole formed at the second end of the casing, and a sliding trough located between the first end and the second end. The slide comprises a compartment and a pair of sliding sections at respective sides thereof to be meshed with the sliding trough of the casing. The buffer is a cylinder to be mounted in the compartment of the slide. A piston rod of the cylinder is secured to the slide. The adjustment comprises a bolt to be connected with the threaded hole of the casing. By screwing the bolt, the slide is adjustable with respect on the casing so as to adjust the position of the buffer.

The slide has a T-shaped trough and the adjustment has a stud corresponding to the T-shaped trough for engagement purpose. Each of the lugs of the casing has a through hole. The bolt of the adjustment is provided with a knob.

It is another objective of the present invention to provide a hinge buffer device, which is simple in structure and has a low production cost.

It is a further objective of the present invention to provide a hinge buffer device, which is easy to operate, simply adjusting the knob of the bolt without the necessary of any tool.

It is still a further objective of the present invention to provide a hinge buffer device, which can be mounted on a hinge base directly instead of a panel, so that when the panel is closed it can only reach to the extension arm of the hinge.

DETAILED DESCRIPTION OF THE PREFERRED EMBODIMENTS

Figure 1:
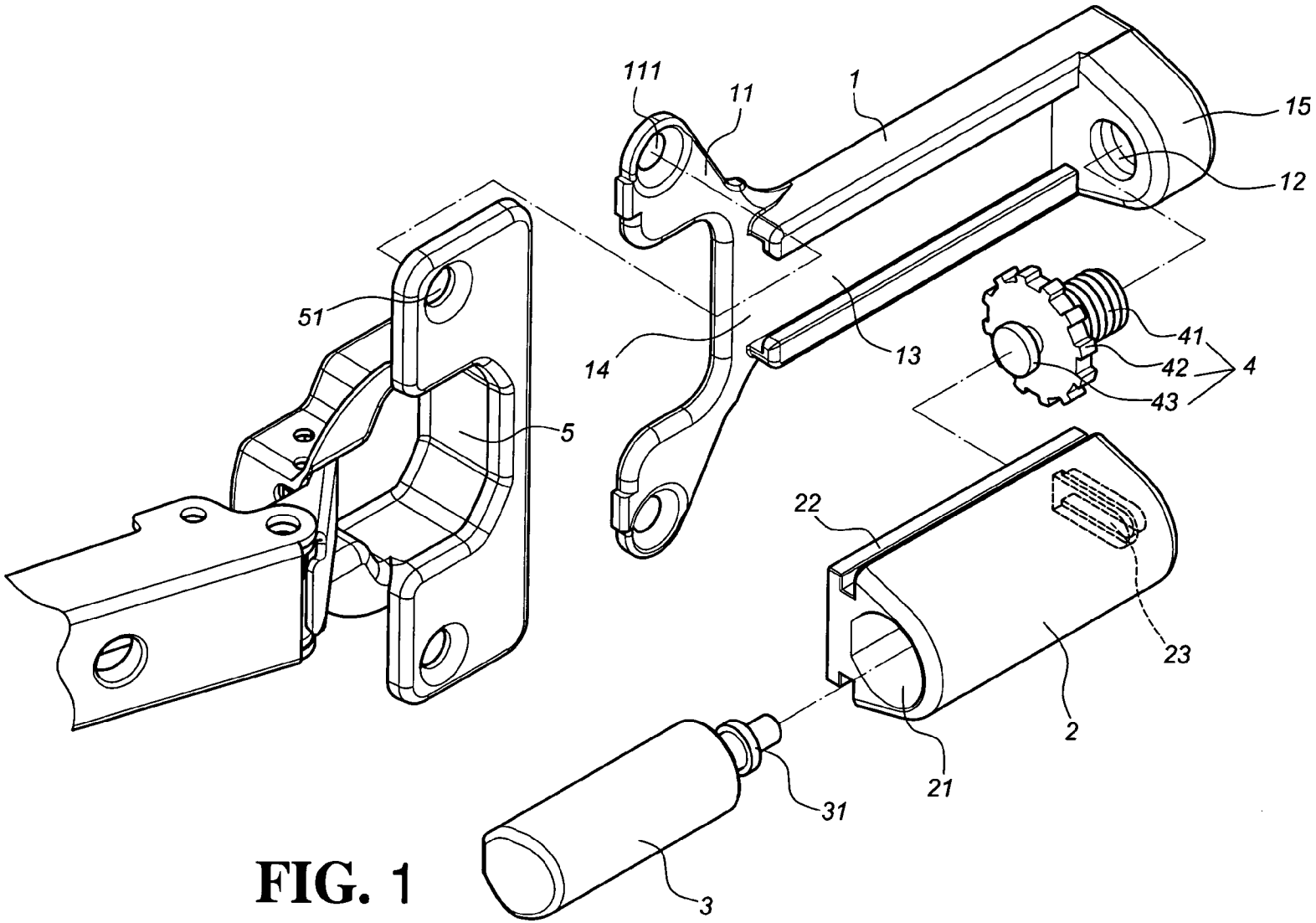
FIG. 1 is an exploded view of a first embodiment of the present invention applied to a hinge.

As shown in FIG. 1, a first preferred embodiment of the present invention comprises a casing 1, a slide 2, a buffer 3 and an adjustment 4.

Figure 2:
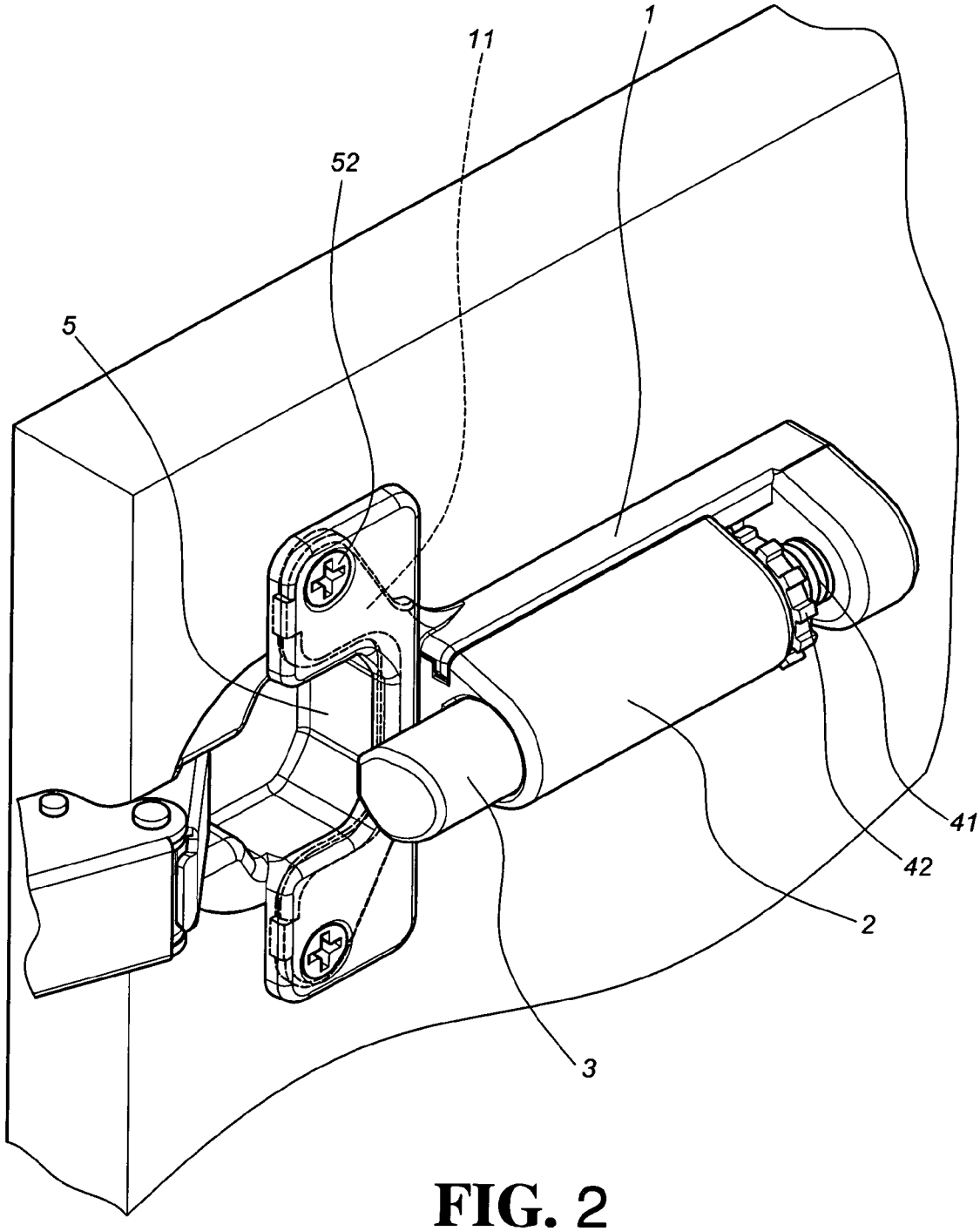
FIG. 2 is a perspective view of the first embodiment of the present invention applied to the hinge mounted on a panel.
Figure 3:
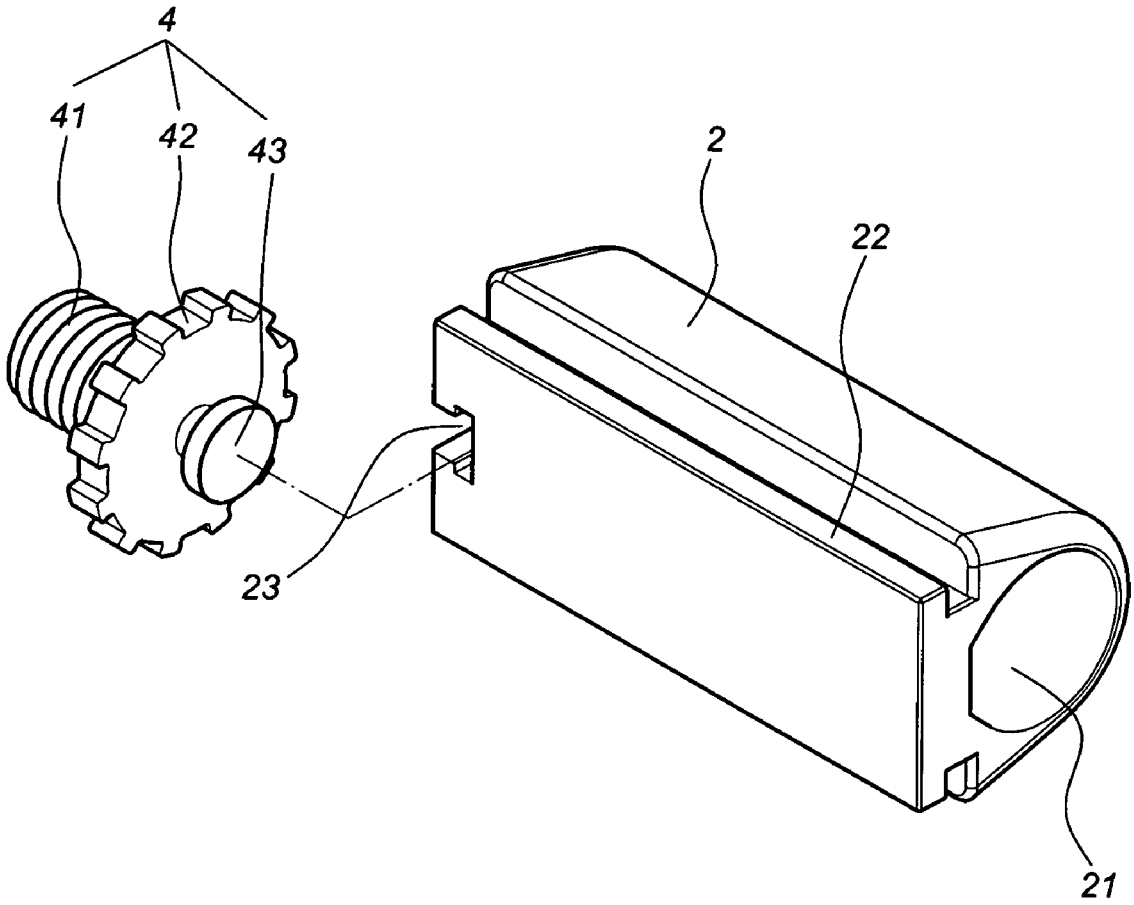
FIG. 3 is a perspective view of a slide and an adjustment of the first embodiment of the present invention.

The casing 1 comprises a pair of lugs 11, a threaded hole 12 and a sliding trough 13. The lugs 11 are formed at respective sides of a first end 14 of the casing 1. Each of the lugs 11 has a through hole 111 corresponding to a threaded hole 51 of a hinge base 5, as shown in FIG. 2, for mounting purpose by means of fasteners 52 to secure the casing 1 and the casing base 5 onto a cabinet panel. The threaded hole 12 is formed at a second end 15 of the casing 1. The axis of the threaded hole 12 is parallel with the sliding trough 13. The sliding trough 13 is located between the first end 14 and the second end 15.

The slide 2 has a compartment 21 therein and a pair of sliding sections 22 at respective sides thereof corresponding to the sliding trough 13 of the casing 1. A T-shaped trough 23 is formed at one end of the slide 2.

The buffer 3 is a cylinder, and comprises a piston rod 31 at one end thereof. The cylinder is mounted in the compartment 21 of the slide 2 while the piston rod 31 is secured to the slide 2. In this embodiment, the cylinder is an air pressure cylinder. The buffer 3 may be either a hydraulic style or a mechanical style.

Figure 4:
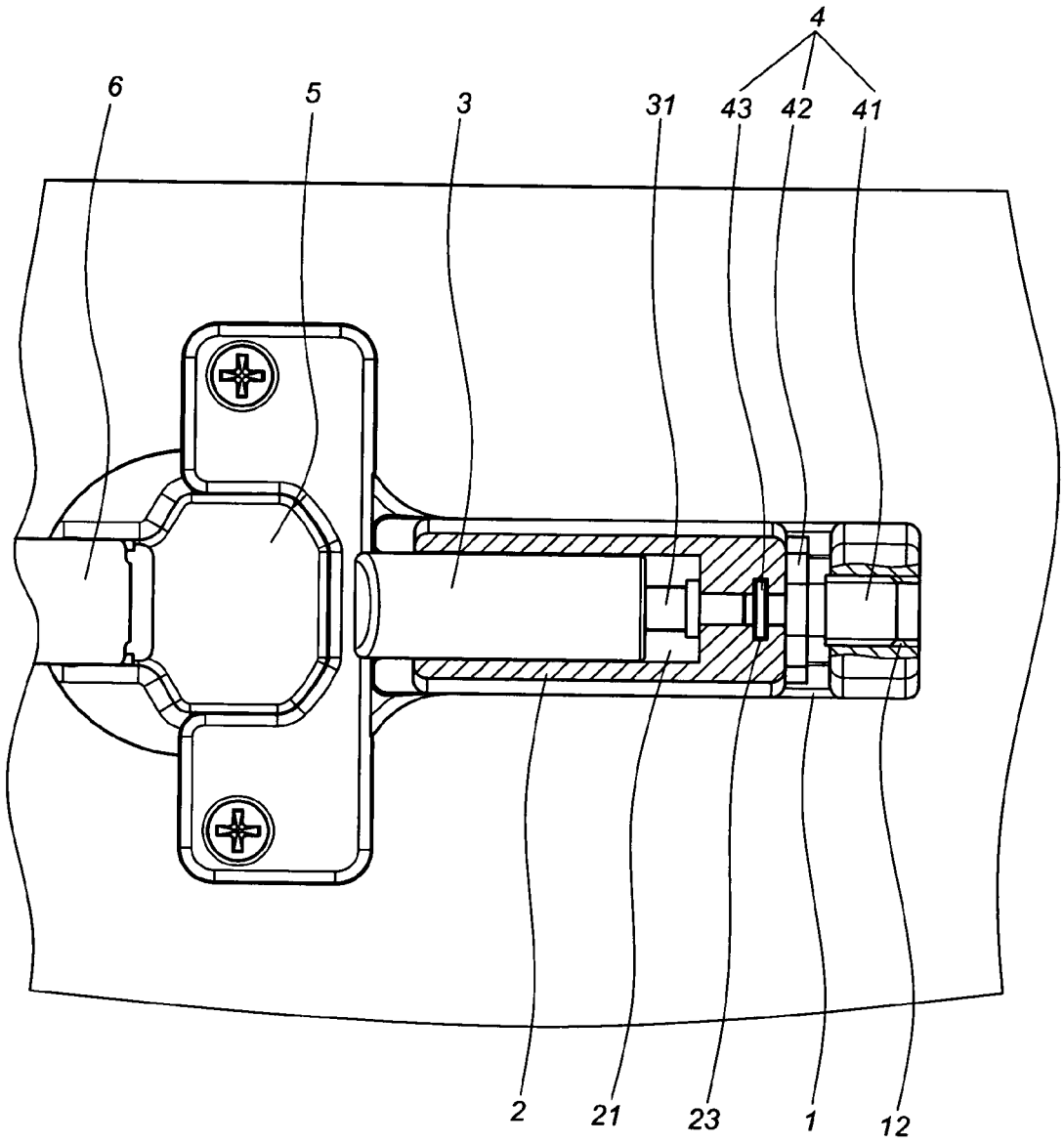
FIG. 4 is a cross-sectional view showing the co-relationship between the slide and the adjustment.

The adjustment 4 comprises a bolt 41 and a knob 42. The bolt 41 corresponds to the threaded hole 12 of the casing 1. The adjustment 4 as shown in FIG. 4, comprises a stud 43 corresponding to the T-shaped trough 23 of the slide 2. The stud 43 has a cross sectional shape that resembles an English letter T.

Figure 5:
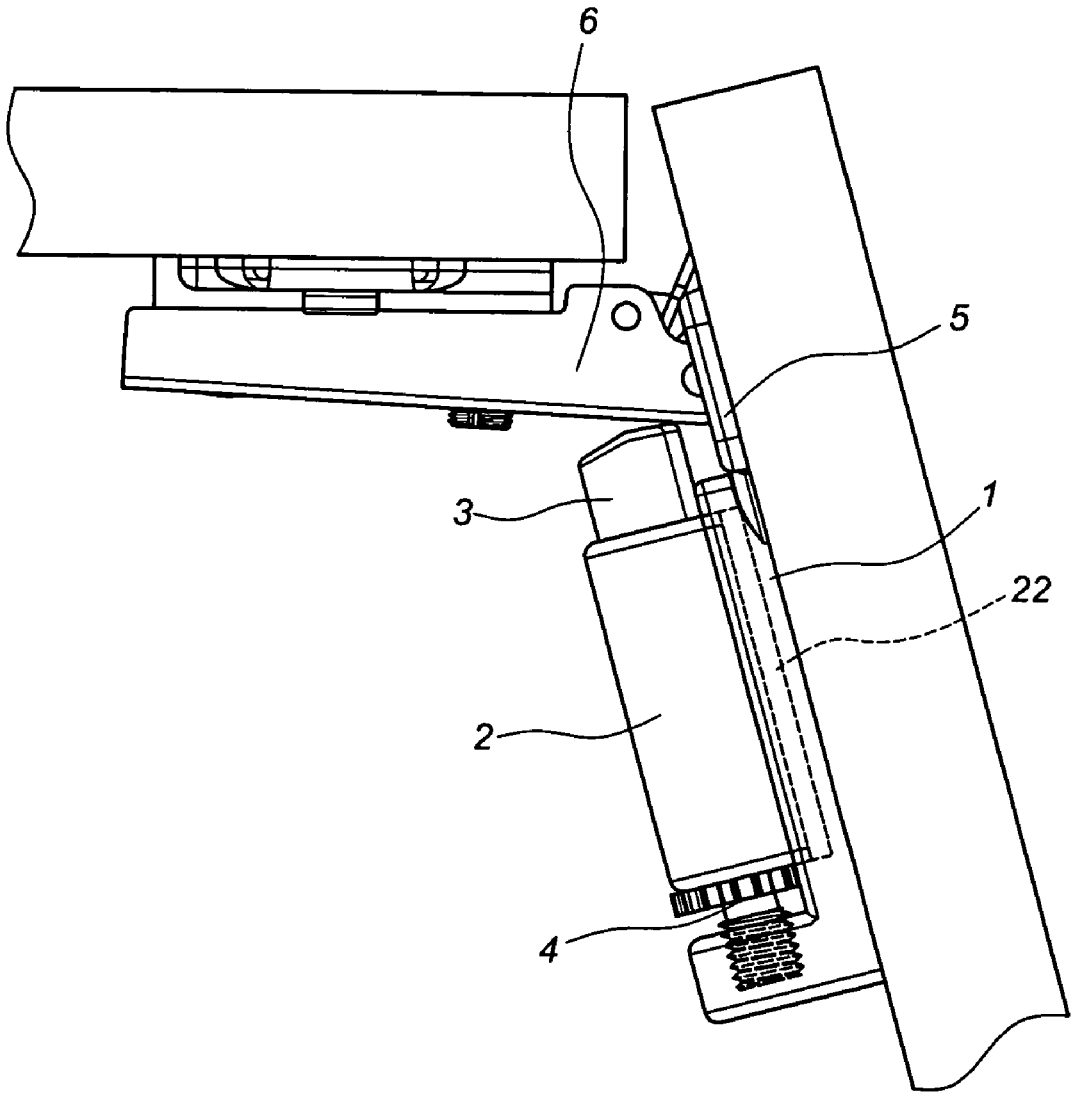
FIG. 5 is a top view of a cabinet panel incorporated with the present invention showing that the panel is slowed down when the hinge is bent at a small angle with respect to the casing.
Figure 6:
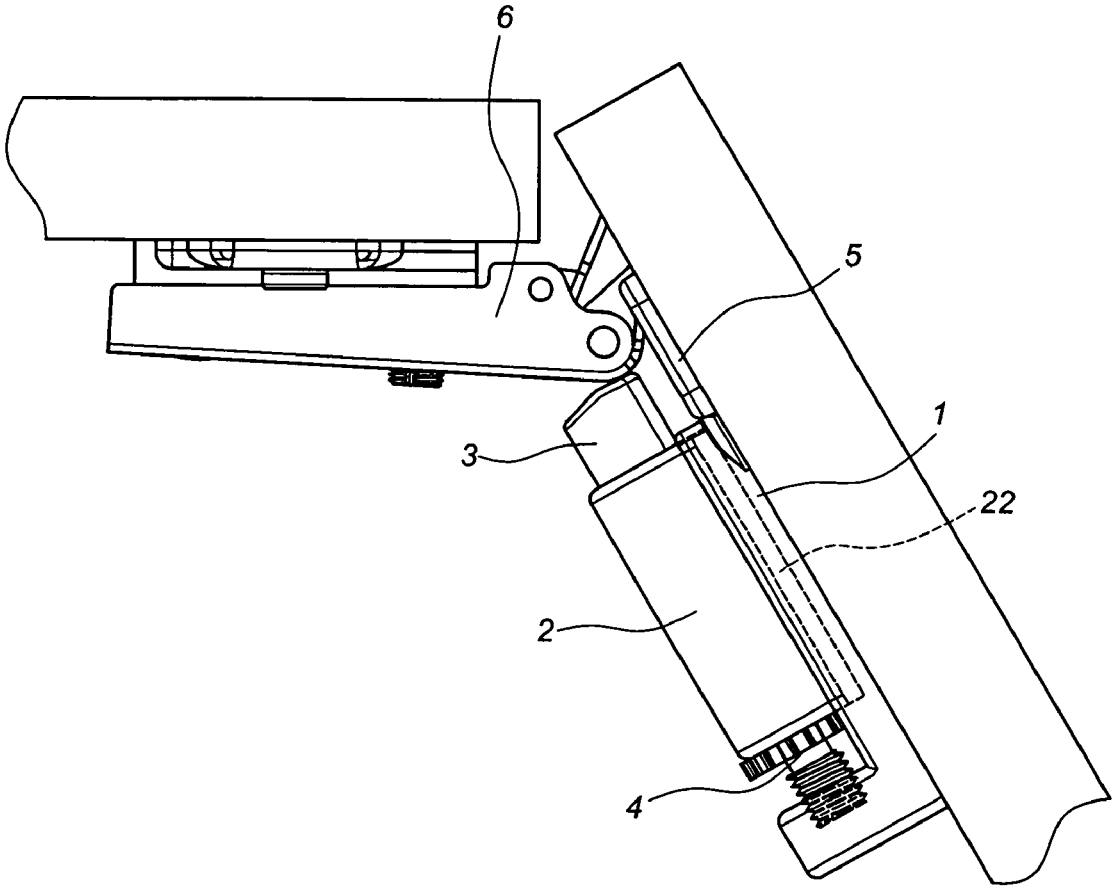
FIG. 6 is a view similar to FIG. 5 showing that the panel is slowed down when the hinge is bent at a larger angle with respect to the casing.

The knob 42 of the adjustment 4 is to screw the bolt 41 in and out of the threaded hole 12 of the casing 1, which links the stud 43 to move the slide 2, as shown FIGS. 5 and 6. That will adjust the reaction of the buffer 3. In other words, when the panel reaches to an appropriate position, a hinge extension arm 6 will engage with the buffer 3. If the buffer 3 is an elastic mechanic type, the pressure from the hinge extension arm 6 will cause the buffer 3 to retreat backward to a distance. The distance is able to be adjusted as required to provide the buffer effect.

Figure 7:
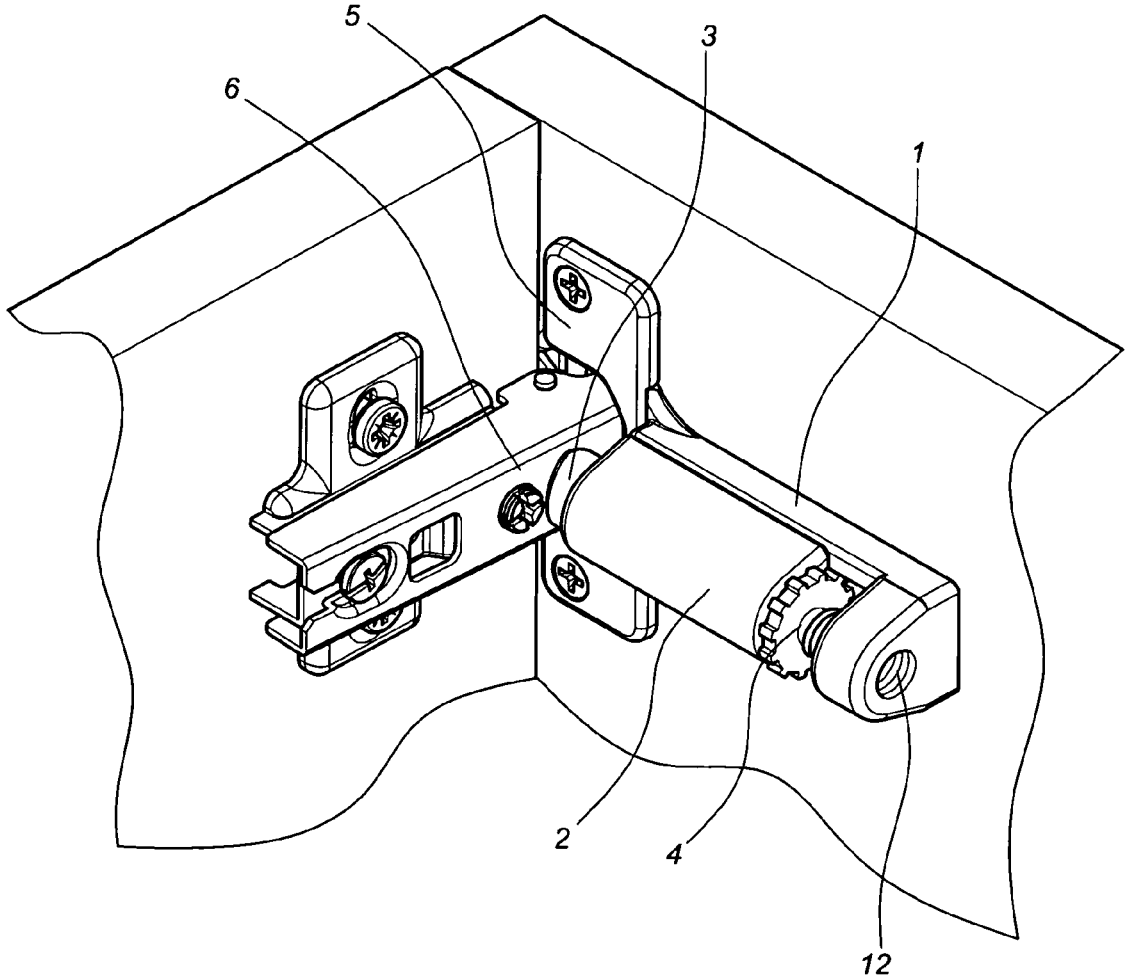
FIG. 7 is a perspective view showing that a cabinet is installed with the present invention in a closed position.

To practice, as shown in FIG. 7, when closing the cabinet panel, the buffer 3 will slow down the panel before it reaches to the hinge extension arm 6 until it final stop.

Figure 8:
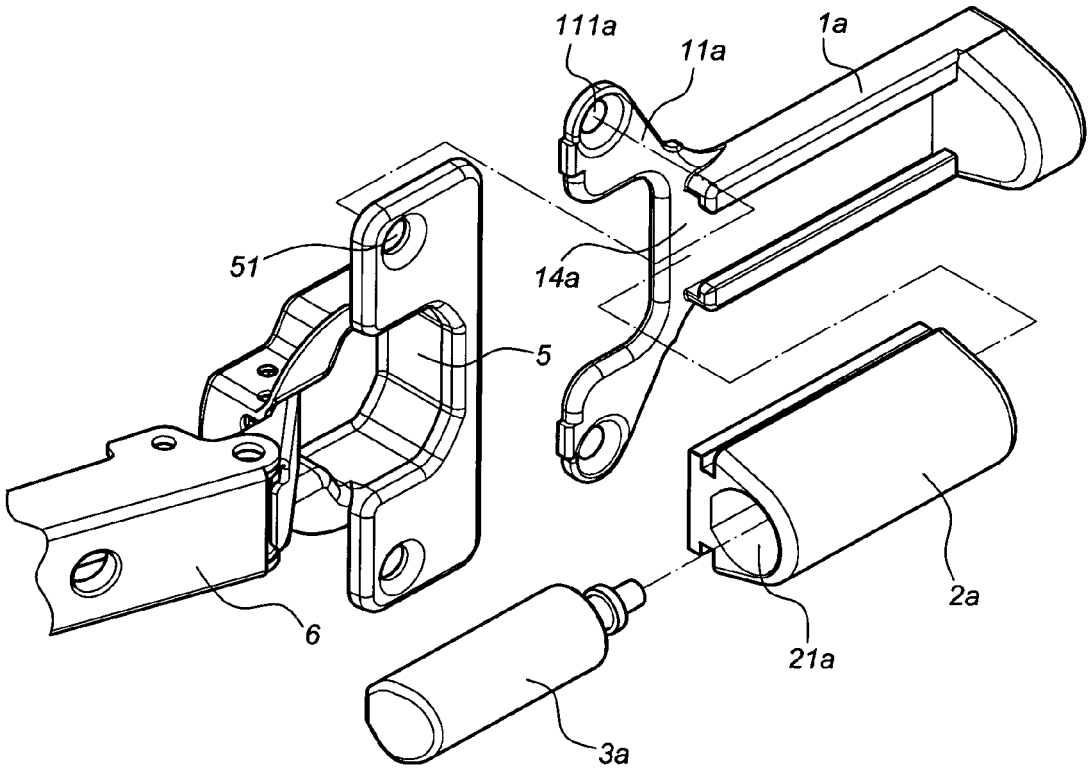
FIG. 8 is a perspective view of a second embodiment of the present invention without the adjustment.
Figure 9:
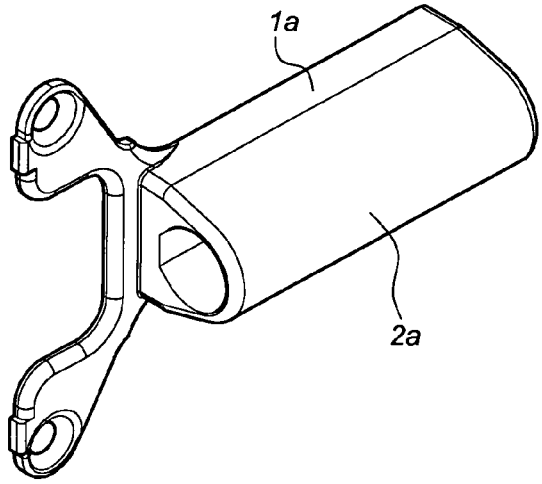
FIG. 9 is a perspective view of the second embodiment of the present invention showing that the slide is formed integrally with the casing.

A second embodiment of the present invention, as shown in FIG. 8, displays a hinge buffer device without the adjustment, and comprises a casing 1*a*, a slide 2*a* and a buffer 3*a*. The casing 1*a* comprises a pair of lugs 11*a* at respective ends of a first end 14*a* thereof. Each lug 11*a* has a through hole 111*a* corresponding to the threaded hole 51 of the hinge base 5. The slide 2*a* has a compartment 21*a* and is secured to the casing 1*a*. The buffer 3*a* secured to the slide 2*a* protrudes from the slide 2*a* towards the lugs 11*a* and engages with the hinge extension arm 6. As shown in FIG. 9, the slide 2*a* may be formed integrally with the casing 1*a*.

What is claimed is:

1. A hinge buffer device, comprising:

a casing comprising a first end, a second end, a pair of lugs formed at respective sides of said first end, a pair of sliding rails extending along respective edges of said casing between said first and second ends thereof, a sliding trough defined at said casing between said sliding rails and extending between said first and second ends, wherein said second end has a threaded hole formed thereat, an axis of said threaded hole being parallel with said sliding trough;

a slide comprising a compartment and a pair of sliding sections at respective sides thereof corresponding to said sliding trough of said casing, said pair of sliding sections of said slide being movable in the sliding trough of the casing;

a cylinder body disposed in said compartment of said slide and having a part protruding outside of said compartment of said slide, said protruding part having a contact end;

a piston rod linearly movable in said cylinder, said piston rod being secured to said slide; and an adjustment comprising a bolt threadedly engaged within said threaded hole of said casing and coupled to said slide, wherein rotation of said bolt results in substantially simultaneous motion of said slide along said casing, thereby adjusting a relative disposition between said contact end of said cylinder body and said first end of said casing.

2. The hinge buffer device, as recited in claim 1, further including a hinge base, wherein each of said lugs has a through hole corresponding to a hole of the hinge base.

3. The hinge buffer device, as recited in claim 1, wherein said slide comprises a trough formed at one end thereof, and wherein said adjustment comprises a stud engaged in said trough of said slide.

4. The hinge buffer device, as recited in claim 3, wherein said trough of said slide, and said stud are formed with their respective cross sections T-shaped.

5. The hinge buffer device, as recited in claim 1, wherein said bolt of said adjustment is provided with a knob.

6. A hinge buffer device, comprising:

a hinge base having a pair of holes;

a hinge extension arm pivotably connected to the hinge base;

a casing comprising a first end, a second end, a pair of lugs formed at respective sides of said casing, and a pair of sliding rails extending along respective edges of said casing between said first and second ends thereof, a sliding trough defined at said casing between said sliding rails and extending between said first and second ends, wherein each said lug has a through hole corresponding to a respective one of the pair of holes of said hinge base;

a slide comprising a pair of sliding sections slidably connected to said sliding trough of said casing, said slide including a longitudinal compartment defined internally thereof;

a cylinder body disposed in said compartment of said slide and having a part protruding outside of the compartment of said slide, said protruding part having a contact end engaging the hinge extension arm to buffer the relative pivotal motion between said casing and said hinge extension arm; and a piston rod linearly movable in said cylinder body, said piston rod being secured to said slide member.

7. A hinge buffer device, comprising:

a casing comprising a first end, a second end, a pair of sliding rails extending along between the first and second ends, and a sliding trough defined at the casing between the pair of sliding rails;

a slide slidably connected to the sliding trough of the casing, the slide comprising a compartment;

a buffer comprising a cylinder body and a piston rod linearly movable in the cylinder body, the cylinder body being disposed in the compartment of the slide, and one part of the cylinder body protruding outside of the compartment of the slide; and an adjustment connected between the casing and the slide, the adjustment comprising a bolt threadedly engaged in either of the casing and the slide;

wherein rotation of the bolt results in substantially simultaneous motion of the slide along the casing, thereby adjusting a relative disposition between the cylinder body of the buffer and the casing.

* * * * *